United States Patent [19]

Poloni

[11] Patent Number: 5,031,523

[45] Date of Patent: Jul. 16, 1991

[54] BINDING MACHINE WITH ROTARY DISTRIBUTOR

[75] Inventor: Alfredo Poloni, Fogliano Di Redipuglia, Italy

[73] Assignee: Danieli C. Officine Meccaniche SpA, Udine, Italy

[21] Appl. No.: 433,227

[22] Filed: Nov. 8, 1989

[30] Foreign Application Priority Data

Nov. 15, 1988 [IT] Italy ..... 83514 A/88

[51] Int. Cl.[5] ..... B65B 13/04

[52] U.S. Cl. ..... 100/25; 100/2; 100/29

[58] Field of Search ..... 100/25, 26, 27, 31, 100/2

[56] References Cited

U.S. PATENT DOCUMENTS

| | | | |
|---|---|---|---|
| 1,875,260 | 8/1932 | Parker | 100/31 |
| 1,983,473 | 12/1934 | Leaver, Jr. | 100/31 |
| 2,088,133 | 7/1937 | Evans | 100/31 |
| 2,191,082 | 2/1940 | Parker | 100/31 |
| 2,330,629 | 9/1943 | Schmidt | 100/31 |
| 2,687,082 | 8/1954 | Cranston, Sr. | 100/31 |
| 2,687,083 | 8/1959 | Cranston, Sr. | 100/31 |
| 2,749,837 | 6/1956 | Hayford et al. | 100/31 |
| 3,012,497 | 12/1961 | Fryer | 100/31 |
| 3,207,060 | 9/1965 | Smith | 100/31 |
| 3,232,216 | 2/1966 | Cranston, Jr. et al. | 100/31 |
| 4,153,499 | 5/1979 | Annis | 100/27 X |

FOREIGN PATENT DOCUMENTS 935155 6/1948 France .

*Primary Examiner*—David T. Fidei
*Assistant Examiner*—Ted Kavanaugh
*Attorney, Agent, or Firm*—Antonelli, Terry, Stout & Kraus

[57] ABSTRACT

Method to bind bundles of rolled, extruded and drawn products or sections, the bundles having a desired, defined geometric section, the binding being obtained with a binding machine comprising at least a twister means (11), a gripper (12) to grip the end of a wire, a shears (13), possible straightening means (14), an assembly (15) to draw the wire and a stationary sector (19) with one or more guide grooves (25), in which method the wire, after being inserted in the guide grooves (25), is tensioned and, leaving the guide grooves (25), is positioned about a plurality of rollers (22–122) borne on a rotary sector (21), the rollers (22–122) being positioned on about 300° of the perimeter of the rotary sector (21), the wire (16) being deposited on the bundle (20) by the rotation of the rotary sector (21) while the assembly (15) to draw the wire takes up the excess wire (16) continuously.

Binding machine to bind bundles of rolled, extruded and drawn products and sections, the bundles having a desired, defined geometric section, the binding machine comprising at least a twister means (11), a gripper (12) to grip the end of a wire, a shears (13), possible straightening means (14), an assembly (15) to draw the wire and a stationary sector (19) with one or more guide grooves (25), a rotary sector (21) cooperating with the stationary sector (19) and comprising a plurality of distributor and transmission rollers (22–122) arranged on about 300° of the perimeter of the rotary sector (21).

20 Claims, 3 Drawing Sheets

BINDING MACHINE WITH ROTARY DISTRIBUTOR

This invention concerns a binding machine with a rotary distributor. To be more exact, the invention concerns a machine to bind bundles of bars, whether the bars are rolled or extruded or are sections or are of any type or shape and are arranged in a bundle having any required cross section.

The binding machine according to the invention, therefore, is suitable to bind bundles having a circular, rectangular, square or hexagonal, etc. section depending on the specific requirements of the product or producer.

The invention concerns also the binding method which can be thus obtained.

Binding machines with a rotary distributor are known. It is known that a binding machine with a rotary distributor comprises a twister means, a drawing assembly, a straightening assembly, a shears, a gripper and a stationary sector including one or more guide grooves in which, whenever the binding starts, a binding wire is caused to run so as to be properly positioned about the circumference of the bundle to be bound.

Italian patent application No. 83453 A/88 (not yet published) in the name of the present applicant discloses a binding machine with a carriage applying a drawing action with friction; the machine comprises a drawing assembly to draw metallic wire, grooves for the circumferential positioning of the wire, a gripper to clamp the head of the metallic wire, a shears to shear the tail of the metallic wire, a twister to bind together the head and tail of the metallic wire and a carriage applying a clamping and drawing action with friction to the metallic wire rotating in cooperation with the grooves.

The binding machines of a known type can perform the binding with one or more revolutions of the wire, thus enabling a very wide range of requirements of an end-user to be met.

The binding machines of a known type entail the shortcoming of performing a binding action whereby the wire is not properly tensioned nor correctly adherent to the bundle to be bound.

The binding action obtainable with the known machines is acceptable for given types of bars, but the binding has to be very tight and adherent for other types of bars or for particular transport and/or storage requirements.

The known binding machines require subsequent action by a man for the final tightening of the binding wire if a binding action of the type indicated above is to be obtained.

The binding machine according to the invention is described in the main claims, while the dependent claims disclose variants of the idea of the main embodiment.

The binding machine according to the invention enables a very tight binding result to be achieved whereby the wire, where it has been wound with one or more revolutions, follows the natural outline of the bundle as closely as possible without leaving wide loops about the corners of the geometric profile of the bundle.

According to the invention the binding machine employs a known basic structure consisting of a drawing assembly, a straightening assembly, a shears, a clamping gripper, a twister means and a stationary sector.

Although the binding machine is described hereinafter according to an embodiment which can be opened into two parts, yet according to the invention in a variant it may also be of a type with a lateral open space for introduction purposes; this can be obtained by varying the geometric form of the component parts and the initial step of the working cycle, as will become clearer hereinafter.

The invention consists in providing a rotary sector in cooperation with the stationary sector; this rotary sector bears a plurality of transmission rollers, which cover substantially an arc of about 300° of the rotary sector.

Moreover, these transmission rollers have a substantially cylindrical conformation, whereas the tail-end distributor roller, which is the roller that lays the wire on the bundle, is advantageously conformed with a concave profile.

According to the invention the tail-end distributor roller may be axially stationary or axially movable.

According to a further variant of the invention the rotary sector may be axially stationary or axially movable; by "axially" is meant axially to the axis of the bundle, which is, moreover, parallel to the axis of rotation of the rotary sector.

The binding wire is inserted into the binding machine and is positioned in the guide grooves with one or more revolutions according to the binding requirements. Systems for inserting the wire into one or more guide grooves are known and are not described here.

The wire thus inserted is then gripped by a terminal gripper and the drawing assembly then begins an action of taking up the excess wire; by moving the wire towards the feeder reel, this action causes the wire to leave the guide grooves and deposists it on the transmission and distributor rollers.

When the wire has been deposited on these rollers, the rotary sector starts rotating and the tail-end distributor roller tends to hold both the wires at its lengthwise centre and to keep them in determined positioning conditions.

As the rotary sector rotates, the wire is rested against the various corners of the bundle and, when it is deposited on the bundle and begins cooperating with the tail-end roller, it passes alongside the tail-end roller and all the rollers therebefore without resting thereupon.

This has the result that, as the rotary sector goes on rotating, the wire passes alongside all the rollers until it has been placed, fully tensioned, about the bundle to be bound.

With the wire deposited in this position, the tail-end distributor roller too discharges the wire and leaves it free to be twisted by the twister and thus to be finally secured.

While the rotary sector is rotating to wind the wire about the bundle, the drawing assembly performs its known action of taking up the wire and keeping it constantly tensioned to the required value.

When twisting has been completed, the bundle or the binding machine is repositioned and the cycle for the successive binding of the same bundle or the next bundle is started. As is known, the same bundle can be bound one or more times.

According to one embodiment of the invention both the stationary sector and the rotary sector can be opened, by a ram for instance, for introduction of the bundle to be bound.

When the bundle has been introduced, the machine assembly is closed and clamped with suitable locking means.

According to another variant the stationary sector comprises a lateral opening suitable for the passage of the bundle to be bound and the rotary sector too includes an opening located between the first transmission roller and the tail-end distributor roller.

When the bundle has been introduced into the binding machine through the two openings, which are caused to coincide for this introduction, the rotary sector is positioned correctly in relation to the twister, while the wire is inserted into the grooves.

The figures, which are given as a non-restrictive example, show the following:

FIG. 1 gives a diagrammatic view of the invention with the binding wire just now inserted and with the rotary sector in its position at the beginning of the cycle;

Figure 1:
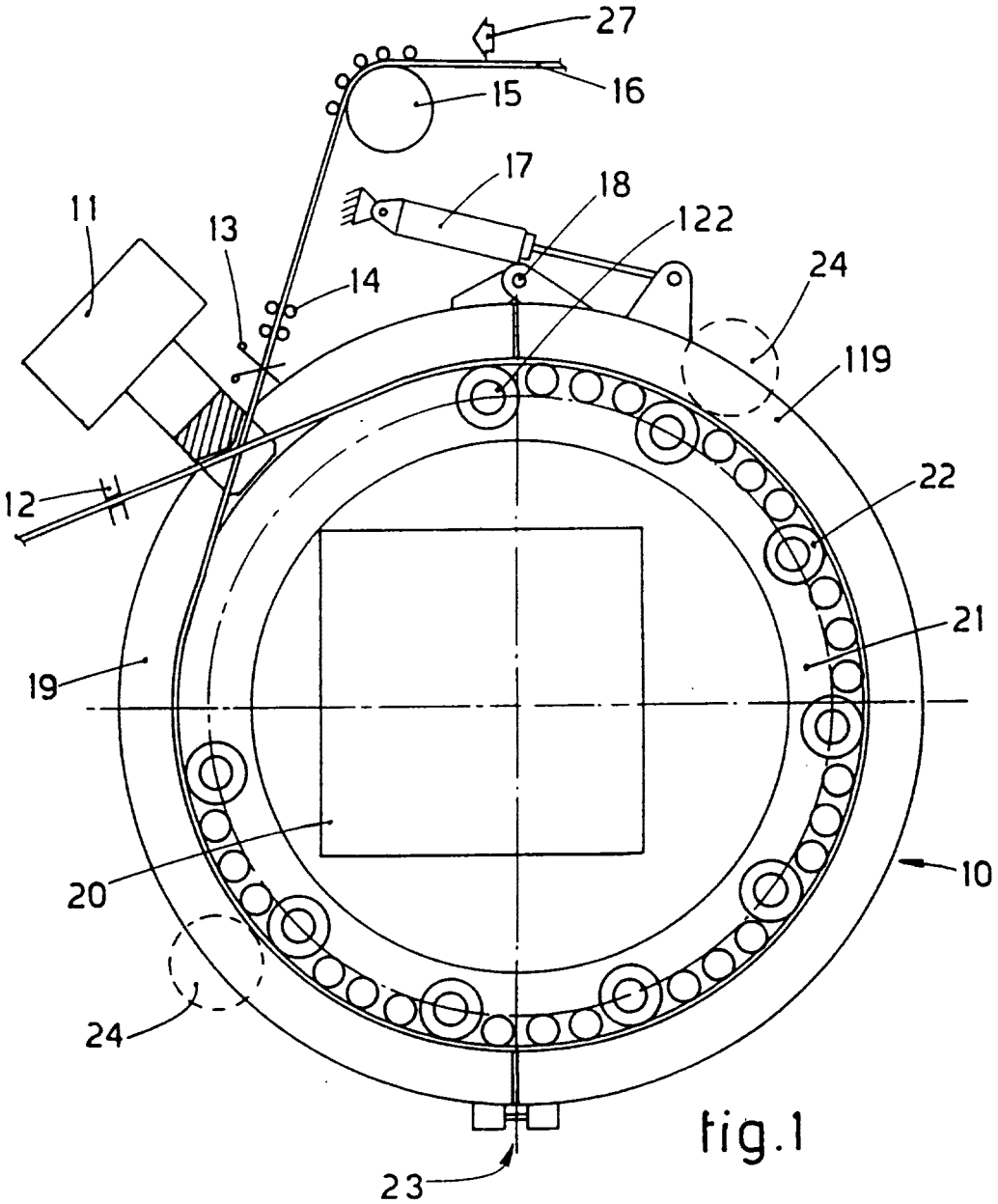
Figure 2A:
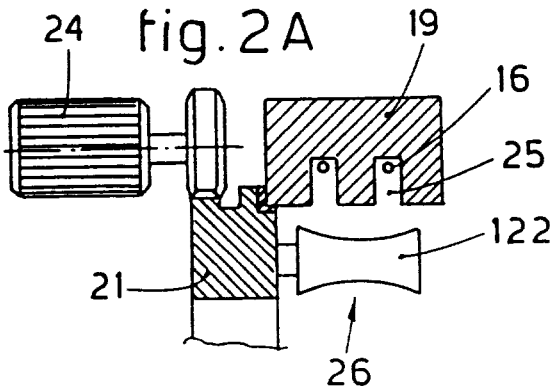
FIG. 2A shows a desired section with the preferred conformation of the distributor roller, comprising a concave surface towards its lengthwise centre, and with two grooves for the passage of the wire.
Figure 2B:
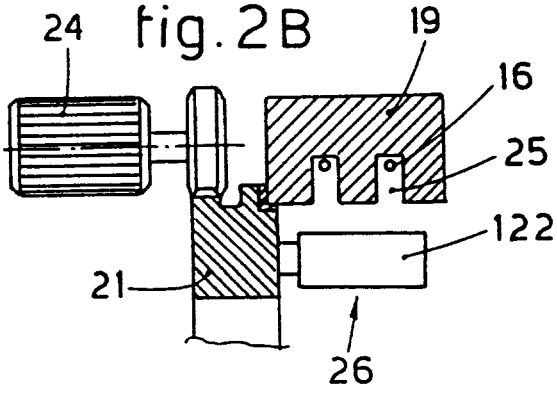
FIG. 2B shows a desired section with the preferred conformation of the distributor roller, comprising a cylindrical surface, and with two grooves for the passage of the wire.

In the figures a binding machine 10 comprises known parts consisting of a twister means 11, gripper 12, shears 13, a straightening assembly 14, a feeding and drawing assembly 15 and a stationary sector 19. In this example it includes also a ram 17, a rotation pivot 18, closure means 23 and a stationary sector 119 which can be opened momentarily for introduction of a bundle 20 to be bound.

In this case a rotary sector 21 too can be opened partly in coincidence with the momentarily openable stationary sector 119.

The stationary sector 19 comprises one or more guide grooves 25 within which binding a wire 16 is made to slide; in this example there are two guide grooves 25. The wire is caused to slide within the guide grooves 25 by a feed action 27 exerted by the drawing assembly 15.

When the wire 16 has been passed through a preselected number of guide grooves 25, it is brought to the gripper 12, which clamps the front terminal part of the wire 16 and by its clamping action halts the feed action 27 of the drawing assembly 15.

When the feed action 27 has ended, the drawing assembly 15 reverses its movement and exerts a drawing and taking-up action 28 which continues in practice until the end of the binding cycle.

The drawing and taking-up action 28 serves firstly to make the binding wire 16 leave the guide grooves 25 and thereafter to take up the excess wire 16 becoming available gradually during the step of winding the wire 16 about the bundle 20 to be bound.

The bundle 20 to be bound can be introduced into the binding machine in several ways.

A first way provides for introduction with a movement axial to the binding machine.

A second way provides for the binding machine to be opened by means of a ram 17, thus causing rotation of the momentarily openable stationary sector 119, which takes with it a suitable portion of the rotary sector 21.

When the binding machine has been opened by rotation of the momentarily openable stationary sector 119 about the rotation pivot 18, the bundle 20 to be bound is introduced and positioned, and then the whole machine assembly is closed and clamped by locking means 23.

It is also possible to introduce the bundle sideways if, as we said, the stationary and rotary sectors comprise suitable openings.

The rotary sector 21 is located within the stationary sector 19 and includes a plurality of distributor and transmission rollers 22–122 positioned substantially along an arc of about 300°.

When the stationary sector 19 comprises a lateral opening as in the case of the cited IT 83453 A/88 (not published), then the rotary sector 21 too may include between its tail-end roller 122 and first transmission roller 22 an opening which, during insertion of the bundle, cooperates with the lateral opening in the stationary sector 19; then when the bundle has been inserted, the rotary sector 21 will be correctly positioned with the tail-end distributor roller 122 located substantially at an angle of 40°–45° in relation to the twister 11.

The tail-end distributor roller 122 may also be located in other positions within 15° on one side or the other of the above, depending on the geometric designing of the parts.

In this example the tail-end distributor roller 122 has a concave profile 26 whereas the transmission rollers 22 are substantially cylindrical.

According to a first embodiment the gripper 12 is positioned displaced lengthwise in relation to the transmission rollers 22 but in a position such as to coincide with a position outside the transmission rollers 22.

According to a variant the tail-end distributor roller 122 is capable of an axial movement.

According to a further variant the whole rotary sector 21 can move axially, that is to say, it can move along the axis of the bundle 20 to be bound.

These variants serve to assist and simplify the passage of the wire 16 alongside the transmission rollers 22 while the wire 16 is being deposited on the bundle 20.

When the drawing assembly 15 has applied its first drawing and taking-up action 28 and has displaced the wire 16 from the guide grooves 25 to the transmission rollers 22, the rotary sector 21 can start rotating.

Figure 3:
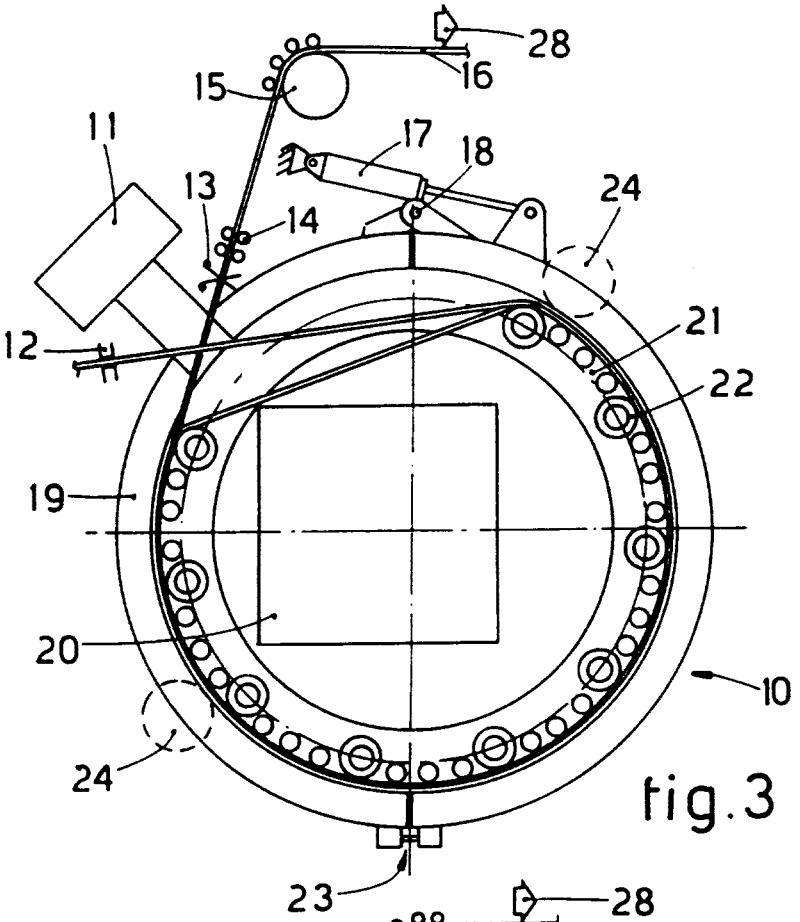
FIG. 3 shows the embodiment of FIG. 1 with the rotary sector rotated by a few degrees from its position at the beginning of the cycle.
Figure 4:
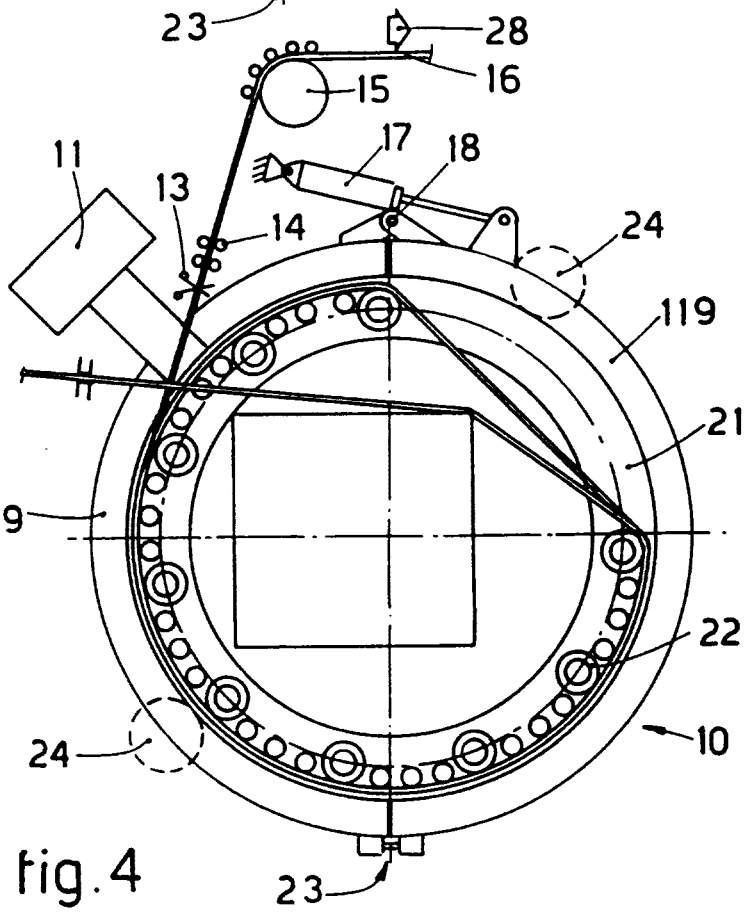
FIG. 4 shows the embodiment of FIG. 1 with the rotary sector rotated by about 90° from its position at the beginning of the cycle.
Figure 5:
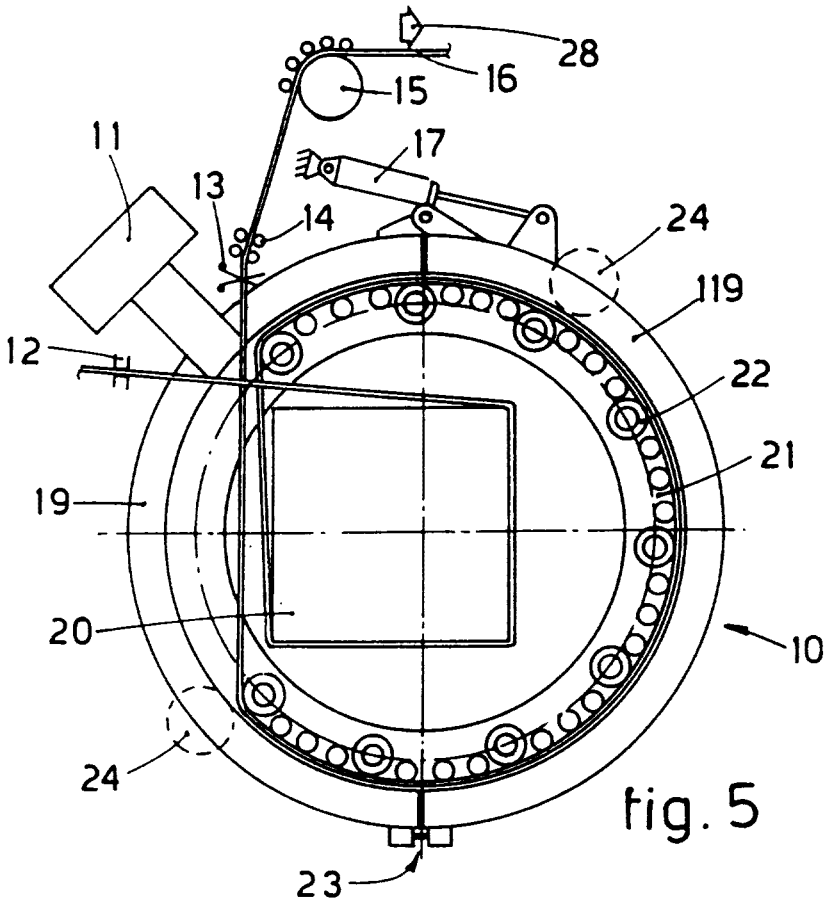
FIG. 5 shows the embodiment of FIG. 1 with the rotary sector rotated by about 310°-320° from its position at the beginning of the cycle.
Figure 6:
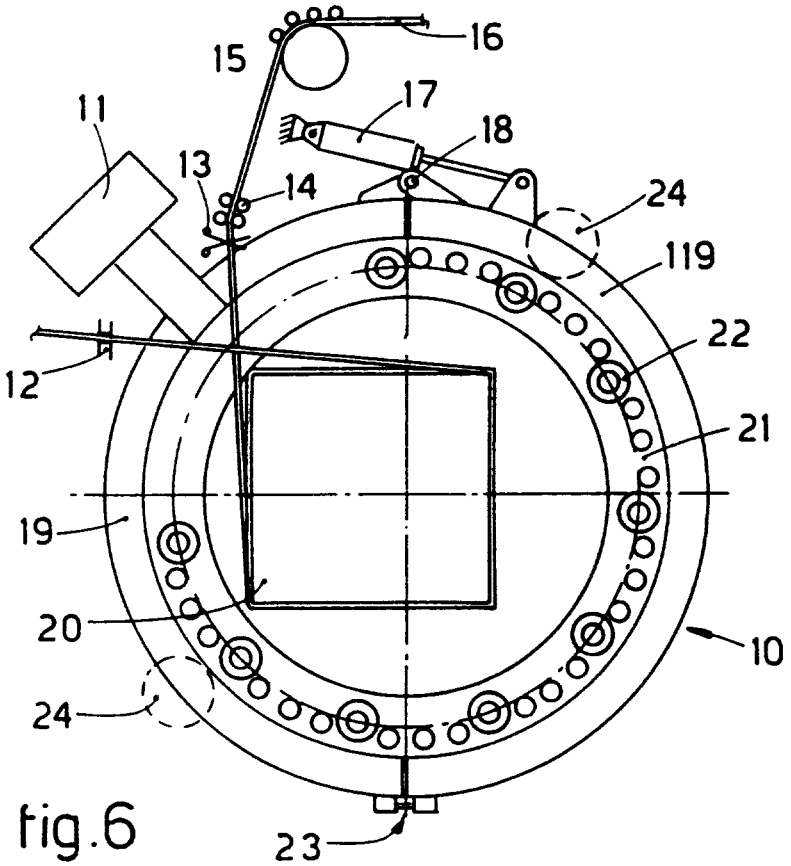
FIG. 6 shows in this case the embodiment of FIG. 1 with the rotary sector rotated by 720° from its position at the beginning of the cycle.

By rotating, the rotary sector 21 deposits on the bundle 20, as shown in FIGS. 3 to 6, the wire 16, which remains constantly tensioned to the desired degree by the drawing and taking-up action 28 exerted by the drawing assembly 15 and by the method of depositing the wire.

Owing to the movement of the rotary sector 21, the wire 16 follows exactly the profile of the bundle 20 without creating loops to be taken up at the corners of the bundle.

Trials conducted have shown that the binding is performed in such a way that the wire 16 follows the circumferential profile of the bundle 20 perfectly and adapts itself to the various circumferential changes of the profile according to a tangent to the various protruding points.

When all the wire has been taken up and its two ends are in the twister 11, the latter 11 is operated in a known way.

It should be noted that the wire 16 remains on the tail-end distributor roller 122 during the whole cycle while it is being deposited on the bundle 20 but ceases resting on the transmission rollers 22 as and when it reaches positions corresponding to those transmission rollers 22.

The cycle is shown clearly in FIGS. 3 to 6.

As a variant, it is possible to arrange that the gripper 12 can move laterally to assist the wire 16 in passing along the rollers while the wire is being deposited on the bundle 20.

I claim:

1. Method to bind bundles of rolled, extruded and drawn products or sections, the bundles having a desired, defined geometric section, the binding being obtained with a binding machine comprising at least a twister means, a gripper to grip the end of a wire, a shears, an assembly to draw the wire and a stationary sector with one or more guide grooves, the method being characterized in that the wire, after being inserted in the guide grooves, is tensioned and, leaving the guide grooves, is positioned about a plurality of rollers borne on a rotary sector, the rollers being positioned on about 300° of the perimeter of the rotary sector, the wire being deposited on the bundle by the rotation of the rotary sector while the assembly to draw the wire takes up the excess wire continuously.

2. Method as claimed in claim 1, in which the wire deposited on the bundle by the rotation of the rotary sector is tensioned by the action of the drawing assembly and by the action of the rollers.

3. Method as claimed in claim 1, in which the wire discharged onto the bundle by the tail-end distributor roller passes alongside the other rollers.

4. Binding machine to bind bundles of rolled, extruded and drawn products and sections, the bundles having a desired, defined geometric section, the binding machine comprising at least a twister means, a gripper to grip the end of a wire, a shears, an assembly to draw the wire and a stationary sector with one or more guide grooves, the binding machine being characterized in that a rotary sector is included in cooperation with the stationary sector and comprises a plurality of distributor and transmission rollers arranged on about 300° of the perimeter of the rotary sector.

5. Binding machine as claimed in claim 4, in which the tail-end distributor roller has a surface which is concave towards its lengthwise centre.

6. Binding machine as claimed in claim 4, in which the tail-end distributor roller has a cylindrical surface.

7. Binding machine as claimed in claim 4, in which the tail-end distributor roller is axially stationary.

8. Binding machine as claimed in claim 4, in which the tail-end distributor roller is axially movable.

9. Binding machine as claimed in claim 4, in which the tail-end distributor roller is movable axially together with the rotary sector.

10. Binding machine as claimed in claim 4, in which the gripper is movable laterally.

11. Binding machine as claimed in claim 4, further comprising straightening means for straightening the wire, the straightening means being provided between said assembly for drawing and said shears.

12. Binding machine as claimed in claim 4, wherein said stationary sector has a plurality of grooves.

13. Binding machine as claimed in claim 4, wherein said grippers are provided outside said rotary sector.

14. Method as claimed in claim 1, further comprising straightening said wire before inserting said wire into said guide grooves.

15. Method as claimed in claim 1, wherein said stationary sector has a plurality of guide grooves.

16. Method as claimed in claim 1, wherein said gripper grips said end of said wire outside said rotary sector.

17. A binding machine for binding bundles of products, comprising:

a ring-shaped stationary sector having at least one guide groove provided in an inside wall thereof and being concentric with said stationary sector;

a rotary sector provided within and concentric to said stationary sector and able to rotate around its central axis within said stationary sector, said rotary sector comprising a plurality of distributor and transmission rollers arranged on about 300° of the perimeter of said rotary sector and able to operate in cooperation with said at least one guide groove;

a gripper to grip a first end of a wire, said gripper being provided outside said rotary sector;

a drawing assembly for feeding a wire in a first direction into said at least one guide groove of said stationary sector and for drawing said wire in a second direction opposite said first direction;

shears provided between said stationary sector and said drawing assembly for shearing said wire; and twister means for twisting said first end of said wire and a second end of said wire sheared by said shears.

18. A binding machine according to claim 17, wherein said stationary sector has a plurality of said guide grooves.

19. A method for binding bundles of products, comprising:

feeding a wire in a first direction into at least one guide groove of a ring-shaped stationary sector, said guide groove being provided in an inside wall of said stationary sector and being concentric with said stationary sector;

gripping a first end of said wire from outside said rotary sector;

tensioning said wire by drawing said wire in a second direction opposite said first direction to withdraw said wire from said at least one guide groove and to position said wire about a plurality of distributor and transmission rollers arranged on about 300° of the perimeter of a rotary sector provided within and concentric to said stationary sector;

rotating said rotary sector while drawing said wire in said second direction to deposit said wire around said bundle;

shearing a second end of said wire; and twisting said first and second ends of said wire.

20. A method according to claim 19, wherein said wire is fed into a plurality of guide grooves in said stationary section.

* * * * *